US012781582B1

(12) United States Patent
Younger et al.

(10) Patent No.: US 12,781,582 B1
(45) Date of Patent: Nov. 3, 2026

(54) DEFORMABLE BALL SEAT

(71) Applicants: SAUDI ARABIAN OIL COMPANY, Dhahran (SA); Aramco Overseas Company BV, Delft (DK)

(72) Inventors: Rae Andrew Younger, Westhill (GB); Abdulrahman K. Aleid, Dhahran (SA)

(73) Assignees: SAUDI ARABIAN OIL COMPANY, Dhahran (SA); Aramco Overseas Company BV, Delft (DK)

( * ) Notice: Subject to any disclaimer, the term of this patent is extended or adjusted under 35 U.S.C. 154(b) by 0 days.

(21) Appl. No.: 19/209,559

(22) Filed: May 15, 2025

(51) Int. Cl.
*E21B 23/04* (2006.01)
*E21B 34/14* (2006.01)

(52) U.S. Cl.
CPC ..... *E21B 23/0413* (2020.05); *E21B 34/142* (2020.05)

(58) Field of Classification Search
CPC ..... E21B 23/0413; E21B 34/142
See application file for complete search history.

(56) References Cited

U.S. PATENT DOCUMENTS

| | | | | |
|---|---|---|---|---|
| 4,889,199 | A | 12/1989 | Lee | |
| 6,253,861 | B1 | 7/2001 | Carmichael et al. | |
| 7,503,392 | B2 * | 3/2009 | King | E21B 34/14 137/845 |
| 9,004,179 | B2 | 4/2015 | Chauffe | |
| 9,482,066 | B2 | 11/2016 | Mackenzie et al. | |
| 2006/0243455 | A1 | 11/2006 | Telfer et al. | |
| 2011/0278017 | A1 * | 11/2011 | Themig | E21B 34/142 166/194 |
| 2012/0111574 | A1 * | 5/2012 | Desranleau | E21B 34/102 166/321 |
| 2013/0037273 | A1 * | 2/2013 | Themig | E21B 34/14 166/185 |
| 2013/0133876 | A1 * | 5/2013 | Naedler | E21B 34/14 166/373 |
| 2014/0102709 | A1 * | 4/2014 | Arabskyy | E21B 43/14 166/308.1 |
| 2014/0246209 | A1 * | 9/2014 | Themig | E21B 34/142 166/194 |

(Continued)

FOREIGN PATENT DOCUMENTS

| | | |
|---|---|---|
| WO | 2009023613 A2 | 2/2009 |
| WO | 2021183379 A1 | 9/2021 |

OTHER PUBLICATIONS

PCT International Search Report & Written Opinion pertaining to International Application No. PCT/US2026/027004; Date of Mailing: Jul. 20, 2026.

*Primary Examiner* — Neel Girish Patel
(74) *Attorney, Agent, or Firm* — Vorys, Sater, Seymour and Pease LLP

(57) ABSTRACT

A plurality of downhole tools may be activated by a ball conveyed through a tool string. Each downhole tool may include a deformable seat that can be plastically deformed by passing the ball therethrough. The plastic deformation may increase a diameter of the seat such that the seat may subsequently be engaged by a larger ball to activate the downhole tool. The plastically deformable ball seats may permit downhole tools to be activated multiple times with varying activation forces and may permit downhole tools in a tool string to be activated out of sequence where upper tools may be activated before lower tools, for example.

20 Claims, 11 Drawing Sheets

(56) References Cited

U.S. PATENT DOCUMENTS

| | | | | |
|---|---|---|---|---|
| 2014/0262324 | A1* | 9/2014 | Greci | E21B 34/10 166/194 |
| 2015/0159462 | A1* | 6/2015 | Cutler | E21B 43/261 166/377 |
| 2016/0017690 | A1* | 1/2016 | Baudoin | E21B 34/142 166/318 |
| 2016/0084040 | A1* | 3/2016 | Brasseaux | E21B 34/10 166/194 |
| 2016/0177656 | A1 | 6/2016 | Streich et al. | |
| 2017/0175487 | A1* | 6/2017 | Marcin | E21B 34/14 |
| 2017/0218741 | A1* | 8/2017 | Arabskyy | E21B 17/1007 |
| 2018/0148993 | A1 | 5/2018 | Schmidt et al. | |
| 2018/0266211 | A1* | 9/2018 | Modeland | E21B 43/14 |
| 2021/0396088 | A1* | 12/2021 | Schultz | E21B 31/113 |
| 2022/0081984 | A1* | 3/2022 | Roselier | E21B 23/0413 |
| 2022/0186577 | A1* | 6/2022 | Boyd | E21B 33/0353 |
| 2023/0084218 | A1* | 3/2023 | Roselier | E21B 33/1208 166/387 |

* cited by examiner

DEFORMABLE BALL SEAT

FIELD OF THE DISCLOSURE

The present disclosure relates generally to downhole tools activated by conveying a ball, a dart or another type of wellbore plugging member through a wellbore, and more particularly to tool strings having downhole tools activatable in any order by passing the ball, dart or other plugging member therethrough.

BACKGROUND OF THE DISCLOSURE

Wellbores may be drilled to recover natural deposits of oil and gas, as well as other desirable materials that are trapped in subterranean geological formations. In some instances, downhole tools are introduced into the wellbores to accomplish a variety of drilling, completion, intervention and reservoir monitoring objectives. Some downhole tools employ balls, darts or other mechanisms for activation, cleaning or communication tasks. For example, downhole tools employed in cementing operations may be wiped clean of cement with a dart passing therethrough. Some other downhole tools may be anchored in the wellbore by dropping a ball onto a seat of the tool and allowing pressure to build behind the tool to extend hangers or seal members to engage other wellbore structures. Similarly, pressure behind a ball may be employed to fracture a shear pin to release a sliding sleeve and open circulation ports defined within a downhole tool.

Multiple downhole tools may be assembled together into a tool string, and each downhole tool may be activated by a different sized ball. The tools may be arranged such that a lowermost tool may define a smallest diameter seat, and such that each successively higher tool in the tool string defines a successively larger diameter seat. A different sized dropped ball may activate each of the downhole tools in the tool string, beginning with a smallest ball that may pass through each of the downhole tools before reaching the smallest diameter seat of the lowermost downhole tool. The downhole tools may be individually operated from the lowermost downhole tool upward by dropping successively larger balls into the wellbore.

However, it may be difficult to operate the tools "out of sequence," e.g., in any other order than from the lowermost downhole tool upward, because, if an upper downhole tool in the tool string is operated with a ball, it may no longer be possible to convey a smaller ball past the larger ball seated in the upper downhole tool. Nevertheless, in some instances, it may be helpful to operate the downhole tools in a tool string out of size sequence.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a method of conducting operations in a wellbore includes (a) deploying a tool string including at least a first downhole tool into the wellbore, the at first downhole tool including a first seat and being selectively movable from a nonactivated configuration to an activated configuration to accomplish a task in the wellbore, (b) conveying a first ball downhole through a wellbore conduit to engage the first seat, (c) pumping a fluid behind the first ball to apply a force on the first ball against the first seat and thereby moving the first downhole tool from the deactivated configuration to the activated configuration and (d) increasing the force applied on the first ball to force the ball through the first seat and thereby plastically deform the first seat from an initial diameter to an enlarged diameter.

According to another example embodiment consistent with the present disclosure, a wellbore system includes a wellbore conduit extending within a wellbore and at least one downhole tool having a flow path fluidly coupled to the wellbore conduit, wherein the at least one downhole tool is selectively movable from a nonactivated configuration to an activated configuration to accomplish a task in the wellbore. A plastically deformable seat extends into the flow path of the at least one downhole tool and defines an initial diameter of the flow path extending through plastically deformable seat. At least one ball is conveyable through the flow path to engage the plastically deformable seat at the initial diameter and thereby obstructing flow of a fluid through the flow path such that a fluid pressure behind the at least one ball increases to move the at least one downhole tool from the nonactivated configuration to the activated configuration. Increasing the fluid pressure behind the at least one ball forces the at least one ball to plastically deform the plastically deformable seat and thereby define an enlarged diameter that permits passage of the at least one ball through the plastically deformable seat.

According to still another example embodiment consistent with the present disclosure, a downhole tool includes a tool body defining a flow path therethrough and an inner sliding sleeve slidable within the tool body. A plastically deformable seat is secured to the inner sliding sleeve and extending radially into the flow path to define an initial diameter of the flow path extending through the plastically deformable seat. The plastically deformable seat is responsive to a ball conveyed through the flow path and engaging the plastically deformable seat to obstruct flow through the flow path such that a fluid pressure behind the ball moves the inner sliding sleeve to a limit of travel, wherein the plastically deformable seat plastically deforms as the fluid pressure behind the ball increases to define an enlarged diameter that permits passage of the at least one ball through the plastically deformable seat.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1C:
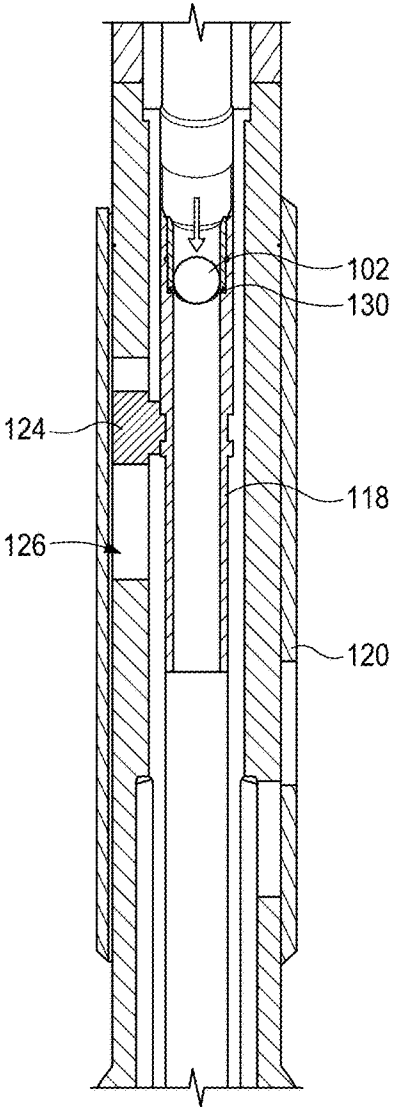
FIGS. 1A through 1E are sequential cross-sectional views of an example downhole tool including a sliding sleeve activated by a ball conveyed therethrough in accordance with one or more aspects of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

There are at least three main types of downhole tools that may be operated by dropping a ball onto a seat. The first type includes tools with rigid ball seats. Most simple ball-activated tools include rigid ball seats that do not deform or permit passage of the ball therethrough. The second type includes single-use ball seats. These single-use ball seats may be split-versions of rigid ball seats. For example, single-use ball seats may include fingers like a collet that may permanently open when the tool is activated with a ball. The third type includes resettable tools. In a resettable tool, a ball or seat may be elastically deformable to permit passage of the ball after activating the tool. An elastically deformable seat may recover after the ball passes therethrough such that the same size ball may be used to cause a subsequent tool actuation. One example of a resettable tool is a PBL® circulation sub. Other resettable tools may include generally rigid seats that may be selectively split to permit passage of a ball and then subsequently reset to receive a subsequently landed ball.

Embodiments in accordance with the present disclosure generally relate to deformable ball seats and downhole tools selectively activated by engaging the ball seats. The deformable ball seats may be permanently or "plastically" deformable such that a passage through the seat expands permanently in response to being engaged by a ball. A plastically deformable seat may move from a first configuration, where the seat extends a first distance radially inward from a threaded insert that holds the seat, to a second configuration, where the seat extends a second distance, smaller than the first distance, from the threaded insert in response to passing a ball through the seat.

Although the terms "ball seat" and "ball" are used herein, it is to be understood that a drop plug or other shaped plugging device, wellbore projectile, or element may be used with the "ball seats" disclosed and discussed herein. For simplicity it is to be understood that the term "ball" includes and encompasses both spherical and non-spherical shapes and sizes of plugs, balls, or drop plugs.

The ball seats may exhibit various geometries such as castellations, tabs or fingers, varying wall thicknesses and stacked layers of different materials. Different resistances to different ball sizes may thereby be provided. Different materials are contemplated such as aluminum and magnesium to permit the ball to dissolve in a ball catcher after the ball has been pumped through the ball seat. Due to the plastic deformability of the seats, a tool string may be provided in which any tool in the string may be activated in any sequence by selecting appropriately selecting the ball sizes to engage with each of the tools in the string. A single ball may activate multiple tools, and/or activate tools "out of sequence," e.g., where larger diameter seats are positioned below smaller diameter seats. In some embodiments, a ball may be constructed of a dissolvable material such as an aluminum alloy, a magnesium alloy or a dissolvable plastic, such that the ball dissolves within wellbore fluids after passing through a deformable seat.

FIGS. 1A through 1E are sequential cross-sectional views of an example downhole tool 100 activated by a ball 102 conveyed through a flow path 104 defined through the downhole tool 100 in accordance with one or more aspects of the present disclosure. The downhole tool 100 may be fluidly coupled to a wellbore conduit 106 such as a drill string, production tubing, coiled tubing, casing or other tubular structure. The wellbore conduit 106 may extend to a surface location (not shown) where an operator may insert (introduce) the ball 102 for conveyance to the downhole tool 100. The downhole tool 100 includes a tool body 110 defining an uphole end 112 and a downhole end 114. The uphole end 112 may be coupled to the wellbore conduit 106 by threads (not shown) or another coupling mechanism recognized in the art. The downhole end 114 may be coupled to an additional section of the wellbore conduit 106, another downhole tool, a ball catcher (see, e.g., FIG. 7), or in some embodiments, the downhole end 114 may be open to the wellbore in which the downhole tool 100 is disposed.

Figure 1B:
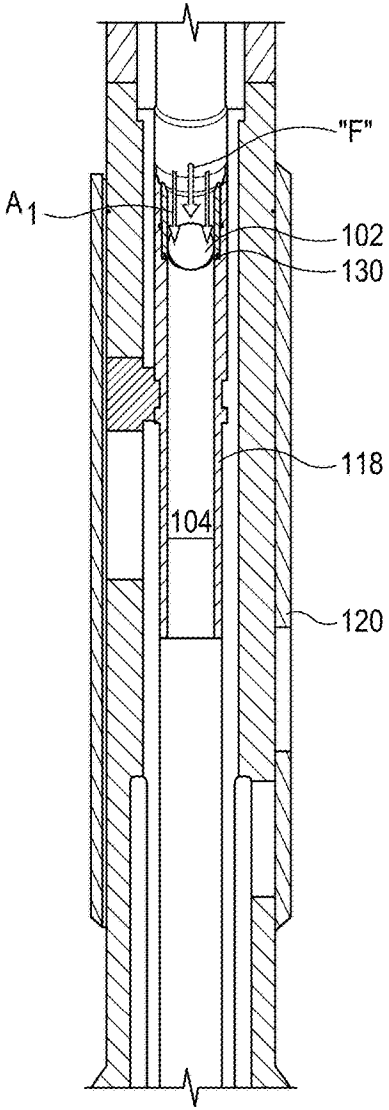
Figure 1A:
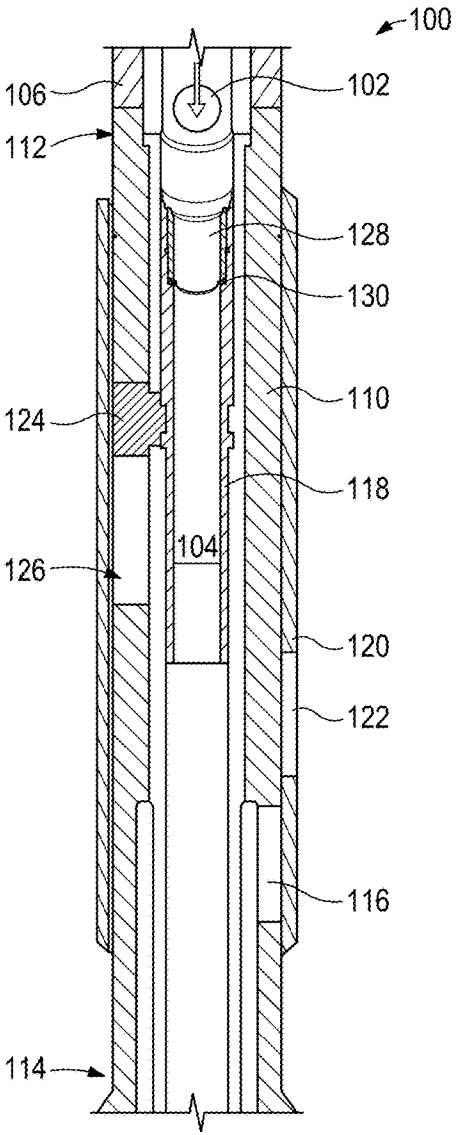

As illustrated in FIG. 1A, the tool body 110 is generally formed of a hollow cylinder with the flow path 104 passing therethrough. At least one port or radial opening 116 is provided through a wall of the tool body 110 to permit passage of fluids between the interior flow path 104 and an annulus (not shown) defined around the downhole tool 100. The downhole tool 100 includes an inner sleeve 118 and an outer sleeve 120, which are longitudinally slidable along the tool body 110. The outer sleeve 120 includes a port or radial opening 122 which may be longitudinally offset from the radial opening 116 in the tool body 110 to prohibit fluid flow in and out of the flow path 104 through the radial opening 116, and may be aligned with the radial opening 116 (see FIG. 1D) to permit passage of fluids through the radial opening 116. The inner sleeve 118 and the outer sleeve 120 are coupled to one another by a connector 124 extending through a longitudinal slot 126 defined within the tool body 110. The inner and outer sleeves 118, 120 may thus slide together along the tool body 110.

A threaded insert 128 may be installed at an uphole end of the inner sleeve 118. The threaded insert 128 may include exterior threads (not shown) thereon to engage corresponding interior threads in the inner sleeve 118 such that the threaded insert 128 may be positionally fixed with respect to the inner sleeve 118. A plastically deformable seat 130 is retained at a downhole end of the threaded insert 128. The plastically deformable seat 130 is illustrated in an initial configuration wherein the plastically deformable seat 130 extends radially into the flow path 104 extending through the threaded insert 128. As described in greater detail below, the plastically deformable seat 130 may be plastically deformed by the ball 102 such that a distance the plastically deformable seat 130 extends into the flow path 104 is reduced, e.g., a diameter of an opening defined through the seat 130 is permanently increased.

Figure 1E:
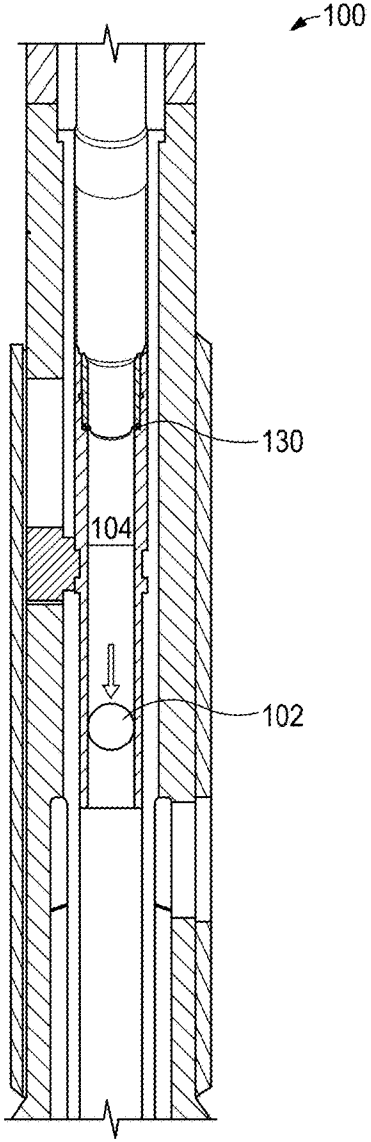
Figure 1D:
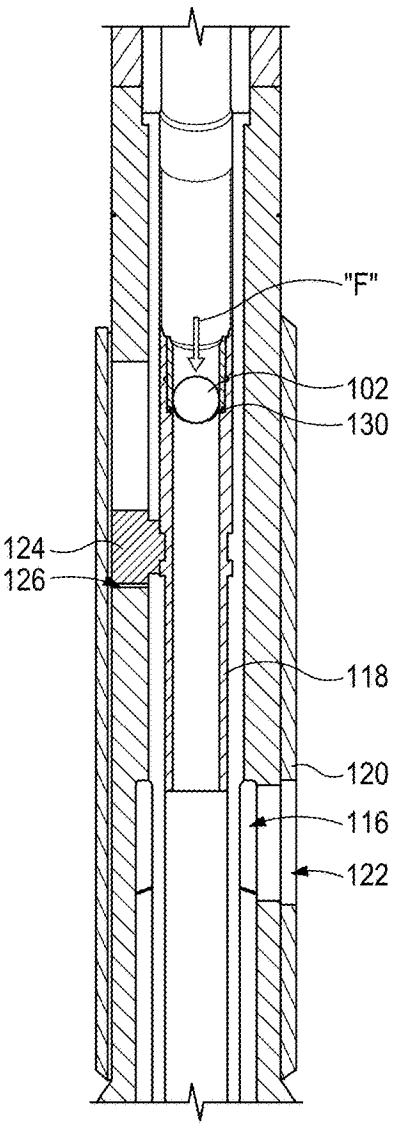

As illustrated in FIG. 1B, the ball 102 may pass freely through the flow path 104 until reaching (locating) the plastically deformable seat 130. The ball 102 may be sized with a diameter larger than that of the plastically deformable seat 130 such that the ball 102 engages the plastically deformable seat 130 to form a blockage through the flow path 104. Rig pumps (not shown) at the surface location may pump a fluid "F" through the flow path 104 to build a pressure behind the ball 104. The pressure applies a longitudinal force to the ball 102 in a downhole direction as indicated by arrows A1. The longitudinal force may cause the inner and outer sleeves outer sleeves 118, 120 to move together in a downhole direction as indicated in FIG. 1C. The ball 102 remains seated on the plastically deformable seat 130 until the inner and outer sleeves 118, 120 reach a limit of travel, e.g., defined where the connector 124 engages an end of the slot 126 as illustrated in FIG. 1D. When the upper and lower sleeves 118, 120 reach the limit of travel, the radial openings 116, 122 may be aligned, and the downhole tool 100 may be activated. As those skilled in the art will recognize, actuation of a downhole tool may not be limited to the movement of slidable sleeves. Any conceivable operation may be initiated and implemented by forcing the ball 102 to press against the plastically deformable seat 130.

The pressure of the fluid "F" may continue to build behind the ball 102 until the ball seat 130 dilates, flexes, or is otherwise sufficiently distorted to permit the ball 102 to pass through the seat 130. As illustrated in FIG. 1E, the ball 102 may then continue through the flow path 104 to another downhole tool or to a ball catcher installed below the downhole tool 100.

Figure 2A:
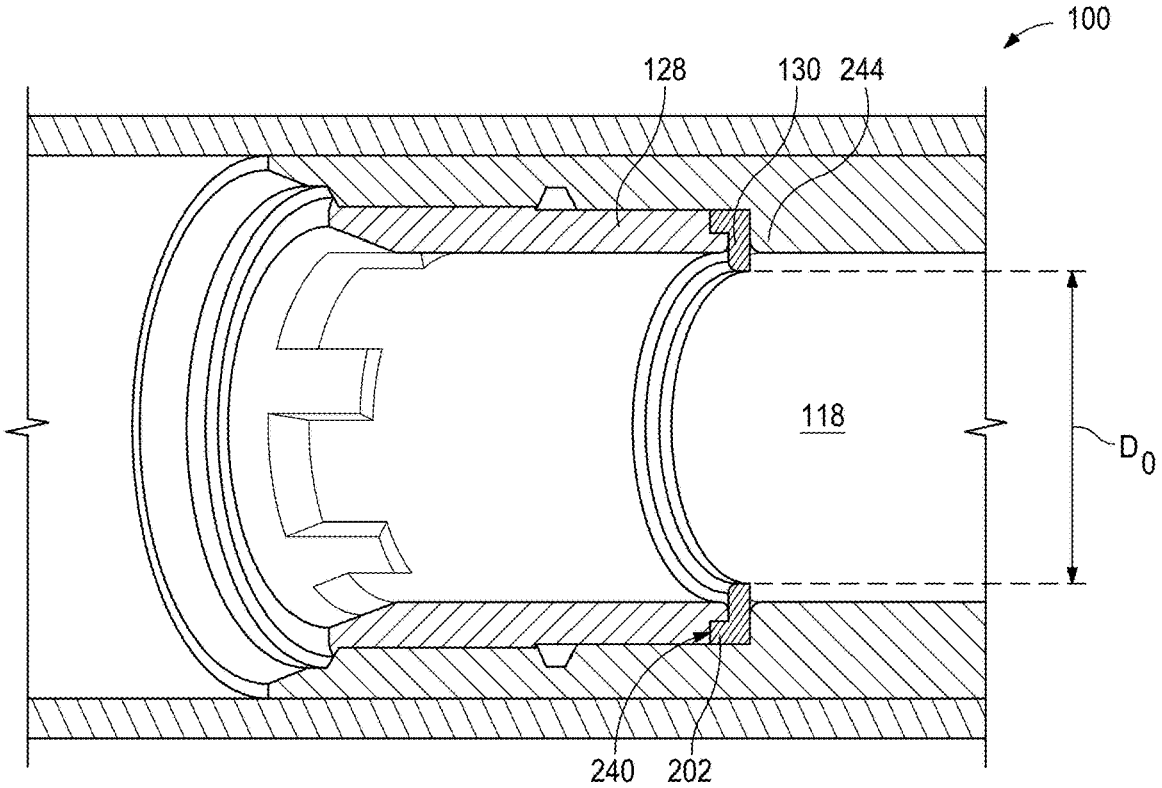
FIGS. 2A and 2B are partial, cross-sectional perspective views of the downhole tool illustrating an example deformable seat in respective initial and deformed configurations. within the sliding sleeve in accordance with one or more aspects of the present disclosure.

FIG. 2A is a cross-sectional perspective view of the downhole tool 100 illustrating the plastically deformable seat 130 in an initial or undeformed configuration. The plastically deformable seat 130 protrudes radially into the flow path 104 from the threaded insert 128. A diameter DO is defined through the plastically deformable seat 130 in the undeformed configuration, and in some embodiments, the plastically deformable seat 130 includes a step or protrusion 202 extending longitudinally into a circumferential recess 240 defined by the threaded insert 128. The step or protrusion 202 may locate and center the plastically deformable seat 130 to prevent the deformable seat 130 from being dislodged as the ball 102 (FIG. 1) plastically deforms the plastically deformable seat 130. The plastically deformable seat 130 may be clamped or otherwise longitudinally retained between the threaded insert 128 and a shoulder 244 defined on an interior of the inner sleeve 118. This arrangement facilitates servicing of the downhole tool 100 since the threaded insert 128 may be readily unthreaded from the inner sleeve 118 to permit removal and replacement of the plastically deformable seat 130.

Figure 2B:
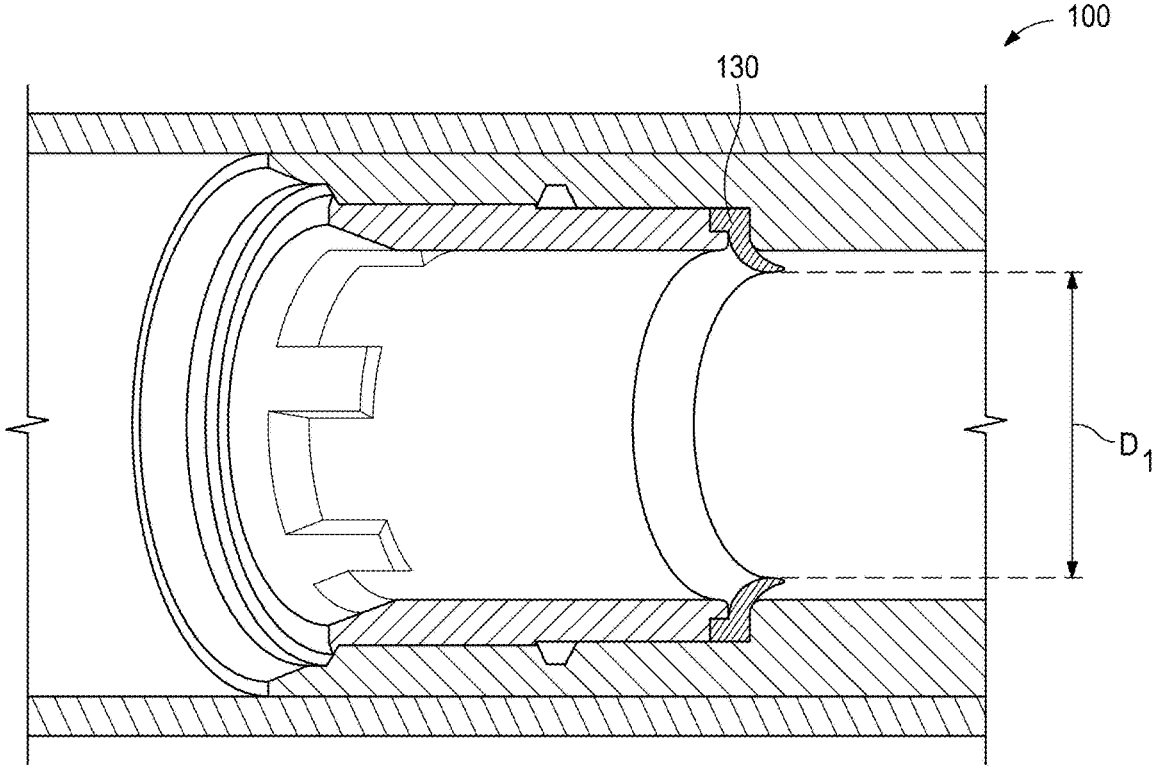

FIG. 2B is a cross-sectional perspective view of the downhole tool 100 illustrating the plastically deformable seat 130 in a deformed configuration. In the deformed configuration, the plastically deformable seat defines an enlarged diameter D1, which is larger than the diameter DO of the plastically deformable seat 130 in the undeformed configuration (FIG. 2A). The plastically deformable seat 130 may be plastically deformed or permanently moved to the deformed configuration by passing (forcing) the ball 102 (FIG. 1D) therethrough as described above. The plastically deformable seat 130 may be constructed of a metallic material, plastic materials, polymer materials, sintered materials, composite materials or any other suitable deformable materials. In some embodiments, the plastically deformable seat 130 may be constructed of ceramic or sintered materials arranged to shatter or crumble in response to passage of the ball 102 therethrough. As illustrated in FIGS. 2A and 2B, the plastically deformable seat 130 forms a continuous ring. The continuous ring may provide a hoop strength such that a relatively large force is necessary to pass the ball 102 therethrough.

Figure 3A:
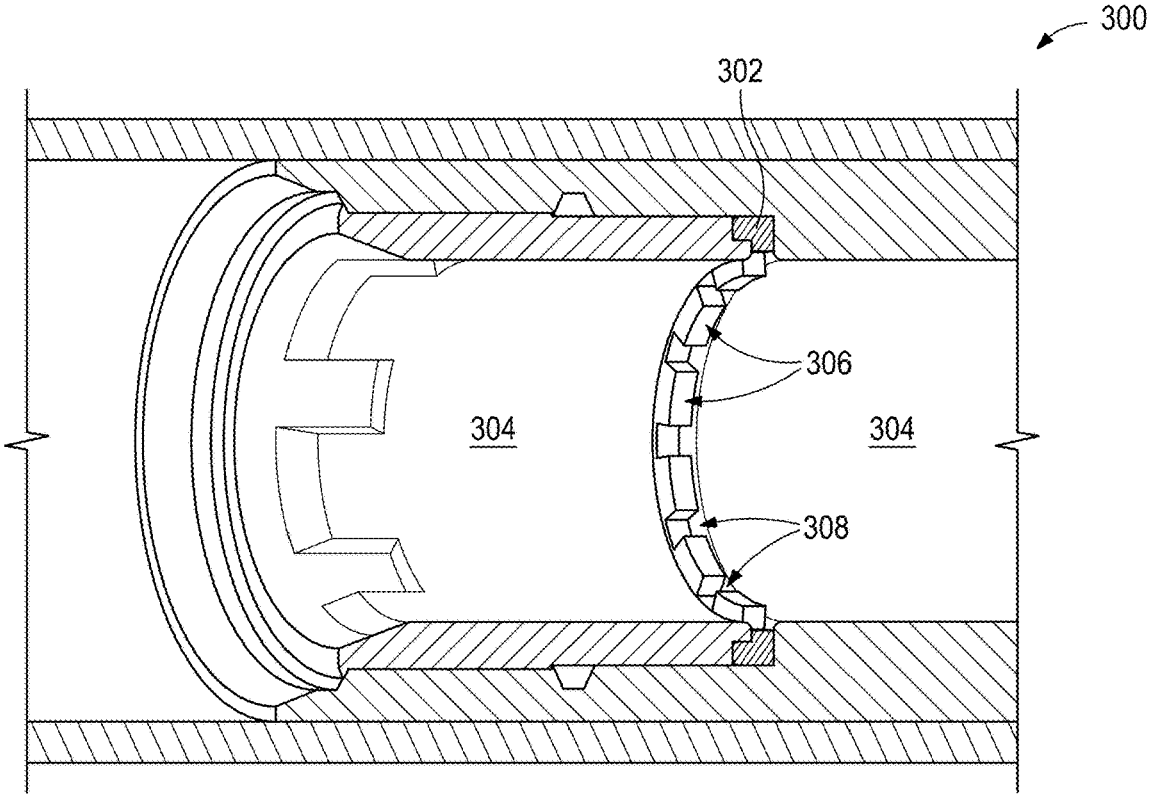
FIGS. 3A and 3B are cross-sectional and perspective views of an alternate example of a castellated deformable seat in installed and uninstalled configurations in accordance with one or more aspects of the present disclosure.
Figure 3B:
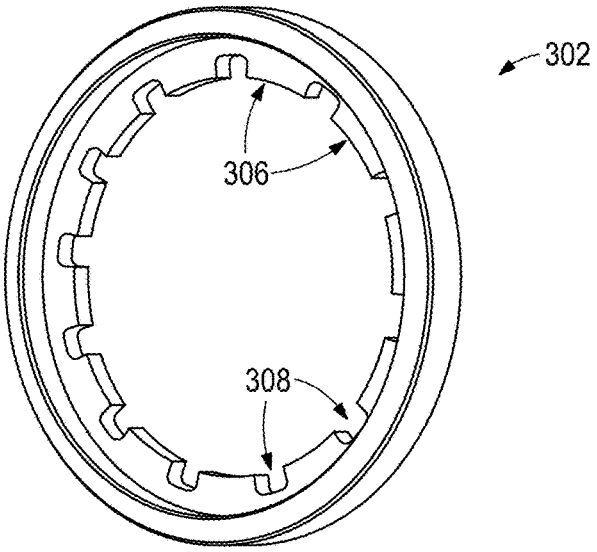

As illustrated in FIGS. 3A and 3B, an alternate downhole tool 300 includes a plastically deformable seat 302 that forms a discontinuous ring around a flow path 304 defined through the downhole tool 304. The plastically deformable seat 302 includes a plurality of discrete arc segments, protrusions or castellations 306 protruding radially into the flow path from the threaded insert 128. The castellations 306 may flex, and do not provide the hoop strength of a continuous ring. Thus, the castellations 306 may facilitate applications where it may be desired to provide a smaller force to pass a ball 102 (FIG. 1D) through the plastically deformable seat 302. The notches 308 defined circumferentially between the castellations 306 may permit a partial passage of fluid around a ball 102 seated on the plastically deformable seat 302.

Figure 4:
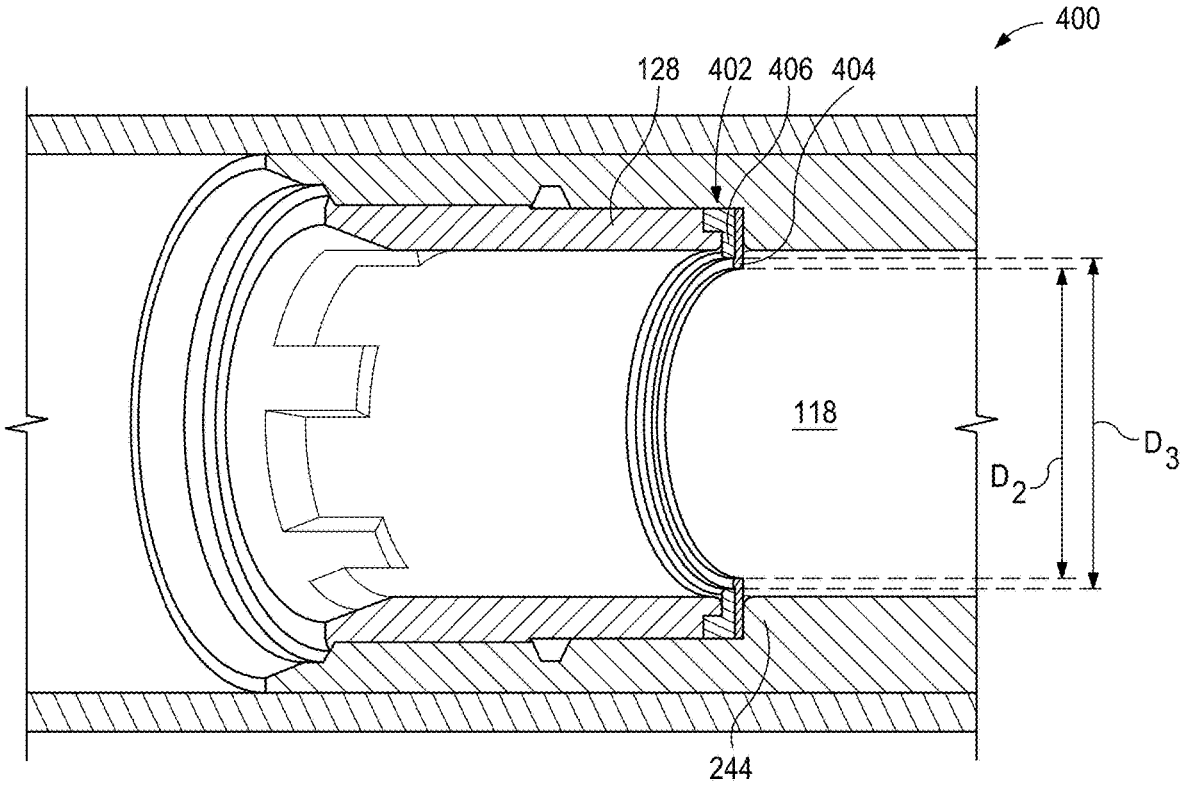
FIG. 4 is a cross-sectional perspective view of an alternate example of a of a layered deformable seat in an installed configuration in accordance with one or more aspects of the present disclosure.

Referring to FIG. 4, a downhole tool 400 includes a plastically deformable seat 402 constructed of multiple distinct layers 404, 406 of similar or different materials. The layers 404, 406 are installed between the threaded insert 128 and the shoulder 244 of the inner sleeve 118. The first or "lowermost" layer 404 may define a diameter D2 that is smaller than a diameter D3 of the second or "upper" layer 406 disposed above the lowermost layer 404. In some embodiments, the lowermost layer 404 may have a thickness that is smaller than a thickness of the upper layer 404. Thus, the lowermost layer 404 may be more flexible than the upper layer 406.

A smaller ball (not shown) may be conveyed to act on the lowermost layer 404 and provide a modest actuation force for the downhole tool 400 before passing through and/or deforming the lowermost layer 404. A larger ball may land on the upper layer 404 and provide a greater actuation force since a higher pressure may be required to cause the larger ball to pass through the thicker and less flexible upper layer 404. In some embodiments, the smaller ball may act on the lowermost seat 404, and subsequently, the larger ball may act on the upper seat 406. The layered, plastically deformable seat 402 may allow for the downhole tool 400 to be actuated multiple times with a single plastically deformable seat 402. An operator may have various options including actuating the downhole tool in different ways and for multiple operations. In other embodiments (not shown) a greater number of distinct layers defining successively larger diameters may be provided to allow for a greater number of actuation cycles. In some embodiments the lowermost layer 404 may be elastically deformable while the upper layer 406 is plastically deformable. In other embodiments, both layers 404, 406 may be plastically or elastically deformable.

Figure 5:
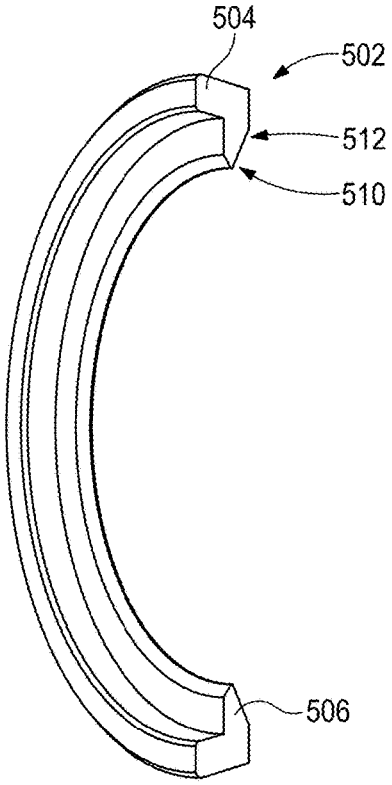
FIG. 5 is a cross-sectional perspective view of an alternate example of a tapered deformable seat in an uninstalled configuration in accordance with one or more aspects of the present disclosure.

FIG. 5 cross-sectional perspective view of an example of a tapered plastically deformable seat 502 in accordance with one or more aspects of the present disclosure. The tapered plastically deformable seat 502 includes a step or protrusion 504 that may extend longitudinally into a circumferential recess 240 (FIG. 2A) of the threaded insert 128 (FIG. 2A). The plastically deformable seat 502 also includes a radially protruding ring 506 extending radially inward from the protrusion 504. The ring 506 has a tapered cross section such that a radially inner portion 510 of the ring 506 has a smaller thickness than a radially outer portion 512 of the ring 506. The plastically deformable seat 502 may thus provide a different resistance to differently sized balls. A smaller ball may act on the radially inner portion 510 of the ring 506 where the plastically deformable seat 502 may be most flexible due to the smaller thickness. The smaller ball may thus provide a relatively modest actuation force for a downhole tool. A larger ball may act on the radially outer portion 512 where the thickness and stiffness of the ring 506 may be greater. Thus, the larger ball may provide a greater actuation force to the downhole tool. In some embodiments, the downhole tool may move to a first actuated configuration when a greater actuation force is applied and may move to a second actuated configuration when the more modest actuation force is applied. The size of the ball may be selected based on which actuated configuration is desired.

In other embodiments (not shown), a plastically deformable seat may be constructed in a variety of other configurations. A plastically deformable seat could be conical or tapered. The plastically deformable seat may be curved or aerodynamically (fluidically) profiled to minimize a pressure drop across the plastically deformable seat. In some embodiments, a plastically deformable seat may be constructed as an incomplete ring such as a scroll or split ring that dilates and opens under a load. A plastically deformable seat may take the form of a circlip that flexes and is able to open at the free ends. A plastically deformable seat may be constructed from a plurality of discrete bristles or flexible fibers.

Figure 6:
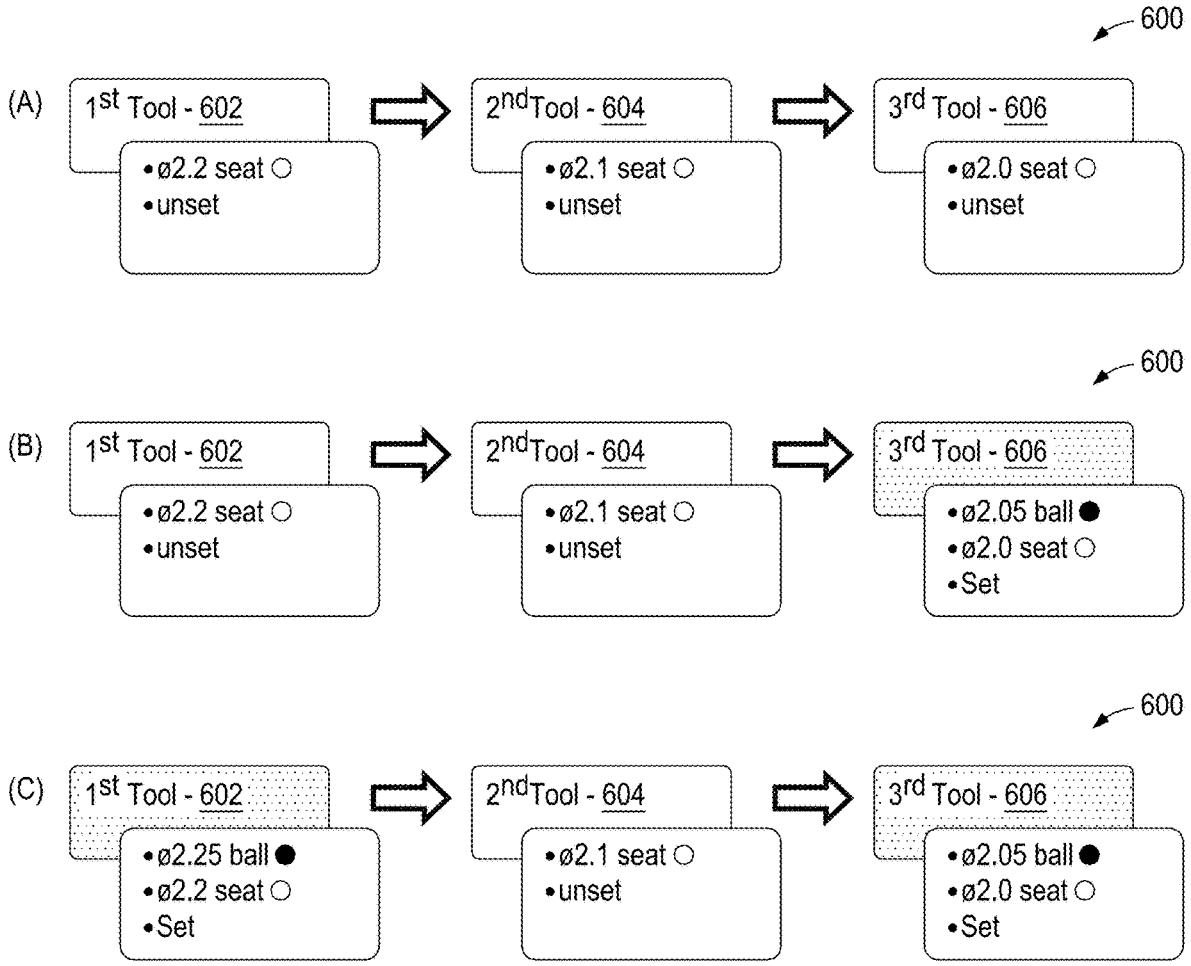
FIG. 6 is a schematic view of an example tool string in three sequential configurations (A, B and C) illustrating an operational scenario for sequentially activating the downhole tools connected within the tool string.

Referring now to FIGS. 6 through 10, various operational scenarios are described for tool strings including downhole tools that are actuated by balls conveyed downhole. FIG. 6 illustrates one example of an operational scenario in which conventional or non-deformable seats are employed to actuate a plurality of downhole tools. The downhole tools 602, 604 and 606 may each be a downhole tool of the first type described above including a rigid ball seat. A first tool 602 is disposed at an upper or uphole end of the tool string 600 and includes a rigid seat defining a 2.2 inch diameter, a second tool 604 is disposed below (downhole from) the first tool 602 and defines a 2.1 inch diameter rigid seat, and a third 606 tool is disposed below (downhole from) the second tool 604 and includes a rigid seat defining a 2.0 inch diameter. The tool string 600 is arranged in a conventional manner in which the rigid seats are successively smaller from the upper end to the lower end of the tool string 600.

Initially, each of the tools 602, 604, 606 may be deployed in an unset configuration as illustrated in row (A). Dropping or conveying a 2.05 inch diameter ball through the tool string may move the tool string to the configuration of row (B). The 2.05 inch diameter ball may pass through the first and second tools 602, 604 and engage the 2.0 inch rigid seat of the third tool 606, thereby activating the third tool 606. The 2.05 inch diameter ball may be retained on the rigid seat of the third tool 606. Next, if it desired to activate the first tool 602, a 2.25 inch diameter ball may be conveyed through the tool string 600 to move the tool string 600 to the configuration of row (C). The 2.25 inch diameter ball may engage the 2.2 inch diameter rigid seat of the first tool 602 and may be retained thereon to activate the first tool 602. The 2.2. inch diameter ball retained in the first tool may block access to the second tool 604 and there may not be any mechanism to unset the third tool 606.

Figure 7:
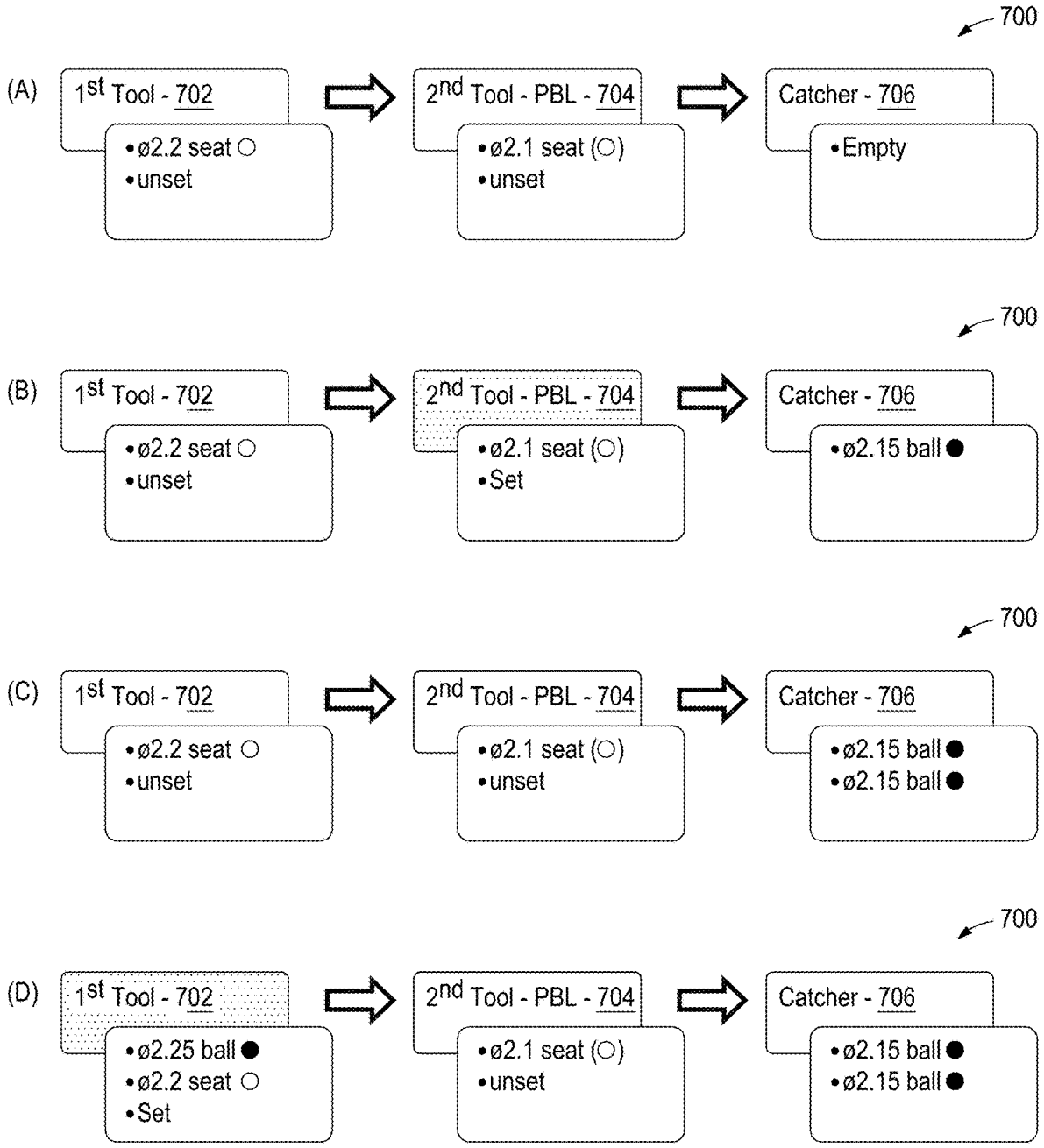
FIG. 7 is a schematic view of an alternate example tool string in four sequential configurations (A, B, C and D) illustrating an operational scenario for sequentially activating and deactivating the downhole tools connected within the tool string.

FIG. 7 illustrates an example of an operational scenario of a tool string 700 in which conventional or non-deformable rigid seat may be employed to activate a first tool 702 and an elastically deformable (and elastically recoverable) seat may be employed to activate a resettable second tool 704. The first tool 702 may have a rigid seat defining a 2.2 inch diameter and the second tool may have an elastically deformable seat defining a 2.1 inch diameter as indicated in FIG. 7. The resettable second tool 704 may be activated by engaging a ball with the elastically deformable seat therein and then passing the ball therethrough. The elastically deformable seat within the resettable second tool 704 may expand to permit the ball to pass, but then may elastically recover and return to its original size. A ball catcher 706 may be coupled in the tool string 700 below the second tool 704 to capture any balls passing through the first and second tools 702, 704.

Initially, the tool string 700 may be deployed in a wellbore with the first and second tools 702, 704 in an unset configuration as indicated in row (A). A 2.15 inch diameter ball may then be passed through the first tool 702 and may engage the elastically deformable seat in the resettable second tool 704 to activate the second resettable tool 704. The ball may then be forced to pass through the resettable second tool 704 to the ball catcher 706 to move the tool string 700 to the configuration of row (B). The elastically deformable seat of the second tool 704 may return to its original diameter after the ball passes therethrough. The tool string 700 may then be moved to the configuration of row (C) by passing another 2.15 inch diameter ball through the tool string 700. The resettable second tool 704 is returned to an unset configuration and the second 2.15 inch diameter ball is caught by the ball catcher 706. The resettable second tool 704 may be set and unset as many times as necessary until it is desired to activate the first tool 702. Then a 2.25 inch diameter ball may be engaged with the rigid seat of the first tool 702, which retains the 2.25 inch diameter ball. The first tool 702 may thereby be set to move the tool string 700 to the configuration of row (D). The 2.25 inch diameter ball in the first tool 702 may block the access to the resettable second tool 704 such that the resettable second tool 704 may no longer be cycled between set and unset configurations.

In other embodiments, the resettable second tool 704 may include a rigid, non-deformable seat and the 2.15 inch diameter balls may be elastically or plastically deformable to pass through the resettable second tool 704 after setting or unsetting the second tool 704. By employing deformable balls rather than an elastically deformable seat in the resettable second tool 704, the tool string 700 may be moved through the operational scenario illustrated in FIG. 7 in a substantially similar manner.

Figure 8A:
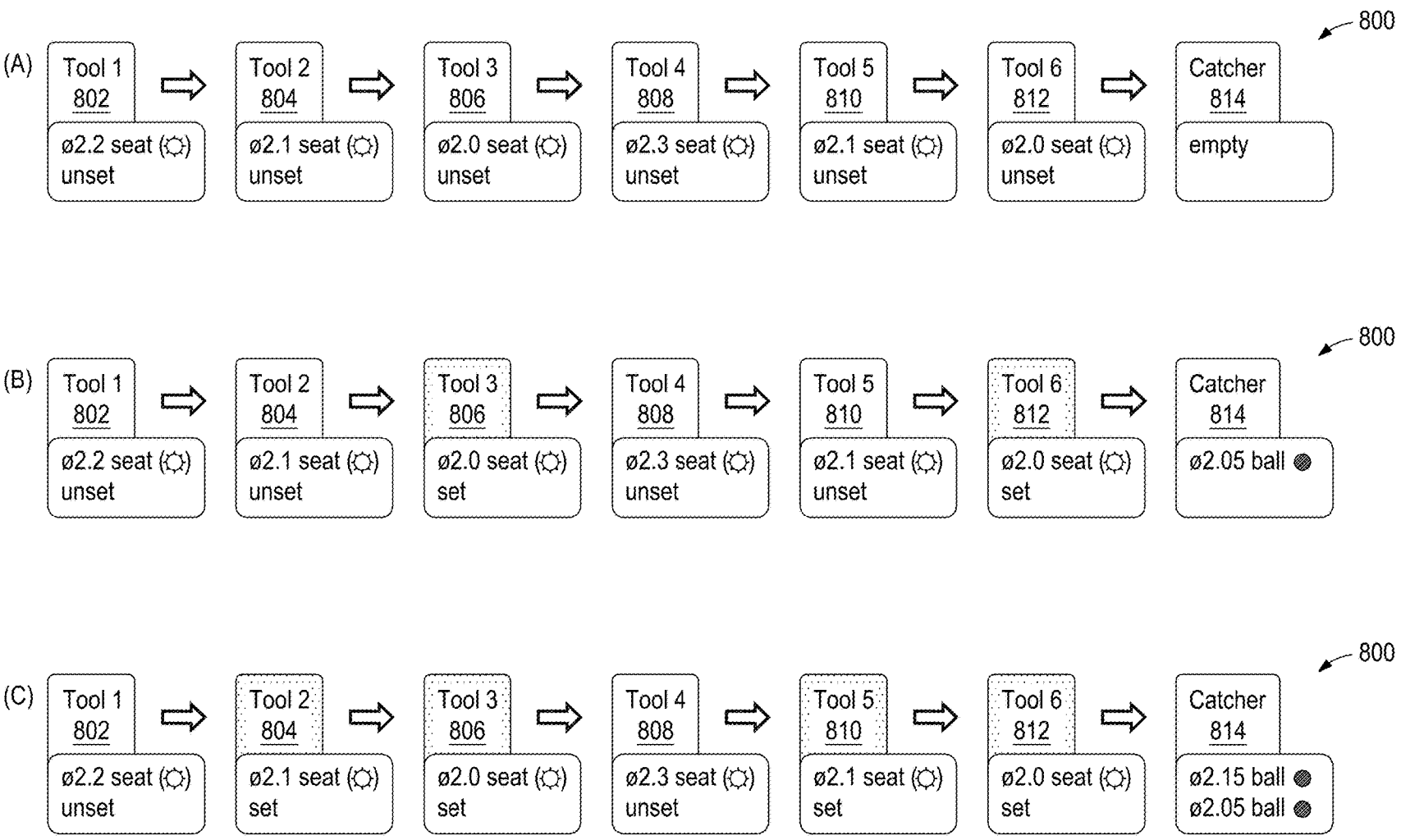
FIGS. 8A and 8B are schematic views of an example tool string in five sequential configurations (A, B, C, D and E) illustrating first and second portions of an operational scenario for activating the downhole tools connected in the tool string out of sequence in accordance with one or more aspects of the present disclosure.
Figure 8B:
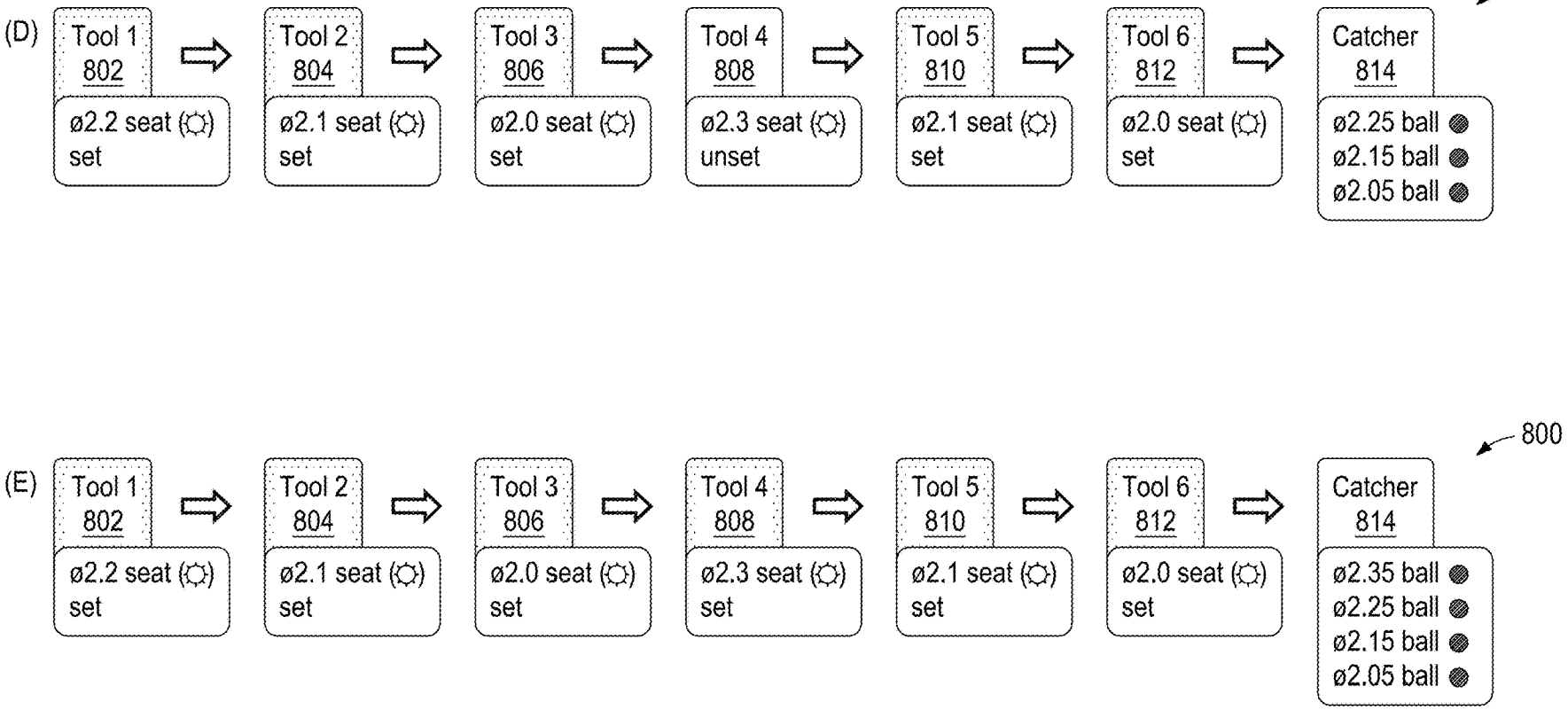

FIGS. 8A and 8B illustrate an operational scenario wherein a tool string 800 may be employed to permit an operator to choose which tools in the tool string 800 to operate in accordance with aspects of the present disclosure. As indicated in FIG. 8A, the tool string 800 includes six different downhole tools 802, 804, 806, 808, 810, 812 and a ball catcher 814 at a lowermost end. Each downhole tool 802, 804, 806, 808, 810, 812 includes a plastically deformable seat that may be engaged a ball to activate the downhole tool 802, 804, 806, 808, 810, 812 as described above with reference to FIG. 1A through FIG. 5. The downhole tools 802, 804, 806, 808, 810, 812 are not necessarily arranged such that the uppermost downhole tool 802 has the largest diameter plastically deformable seat and the lowermost downhole tool 812 has the smallest diameter plastically deformable seat. Specifically, in the illustrated example, the uppermost or first downhole tool 802 has a 2.2 inch diameter plastically deformable seat, second and fifth downhole tools 804, 810 in the tool string 800 have a 2.1 inch diameter plastically deformable seat, a third and sixth downhole tool 806, 812 in the tool string 800 have a 2.0 inch diameter plastically deformable seat and a fourth downhole tool 808 in the tool string 800 has a 2.3 inch diameter plastically deformable seat. An operator may drop a suitably sized ball to activate the downhole tools 802, 804, 806, 808, 810, 812 in various orders. An initial single ball will activate any and all of the downhole tools 802, 804, 806, 808, 810, 812 that have plastically deformable seats smaller than the dropped ball. If a subsequently dropped ball is larger than the initial ball, then the subsequently dropped ball will activate all of the downhole tools 802, 804, 806, 808, 810, 812 which have a plastically deformable seat smaller than the subsequently dropped ball and will also forcibly pass through the plastically deformable seats of any of the downhole tools 802, 804, 806, 808, 810, 812 that may have already been activated.

As indicated in row (A) each of the downhole tools 802, 804, 806, 808, 810, 812 in the tool string 800 may initially be deployed in a deactivated or unset state. If an operator drops a 2.05 inch diameter ball, the tool string 800 moves to the configuration of row (B). The 2.05 inch diameter ball activates both the third downhole tool 806 and the sixth downhole tool 812 and passes through the plastically deformable seats of the other downhole tools 802, 804, 808, 810. The third downhole tool 806 is not the lowermost one of the downhole tools 802, 804, 806, 808, 810, 812 and is therefore activated out of sequence. If the operator then drops a 2.15 inch diameter ball, the tool string 800 is moved to the configuration of row (C). The second and fifth downhole tools 804, 810 are moved to an activated configuration while the third and sixth downhole tools 806, 812 remain in their activated configurations. Again, a plurality of downhole tools 804, 810 are activated by a single ball and the second downhole tool 804 is activated out of sequence.

Next, as indicated in FIG. 8B, the tool string 800 is moved to the configuration of row (D) by dropping a 2.25 inch diameter ball is dropped to activate the uppermost or first downhole tool 802 while leaving the fourth downhole tool 808 in the deactivated state. Finally, the tool string 800 is moved to the configuration of row (E) by dropping 2.35 inch diameter ball to activate the fourth downhole tool 808 disposed in a central portion of the tool string 800. Each of the balls dropped is retained in the tool catcher 814. As described above, in some embodiments, the balls may dissolve in the ball catcher 814 after passing through the tool string 800. A dedicated ball catcher 814 can allow for a larger flow path through the tool string 800.

Figure 9:
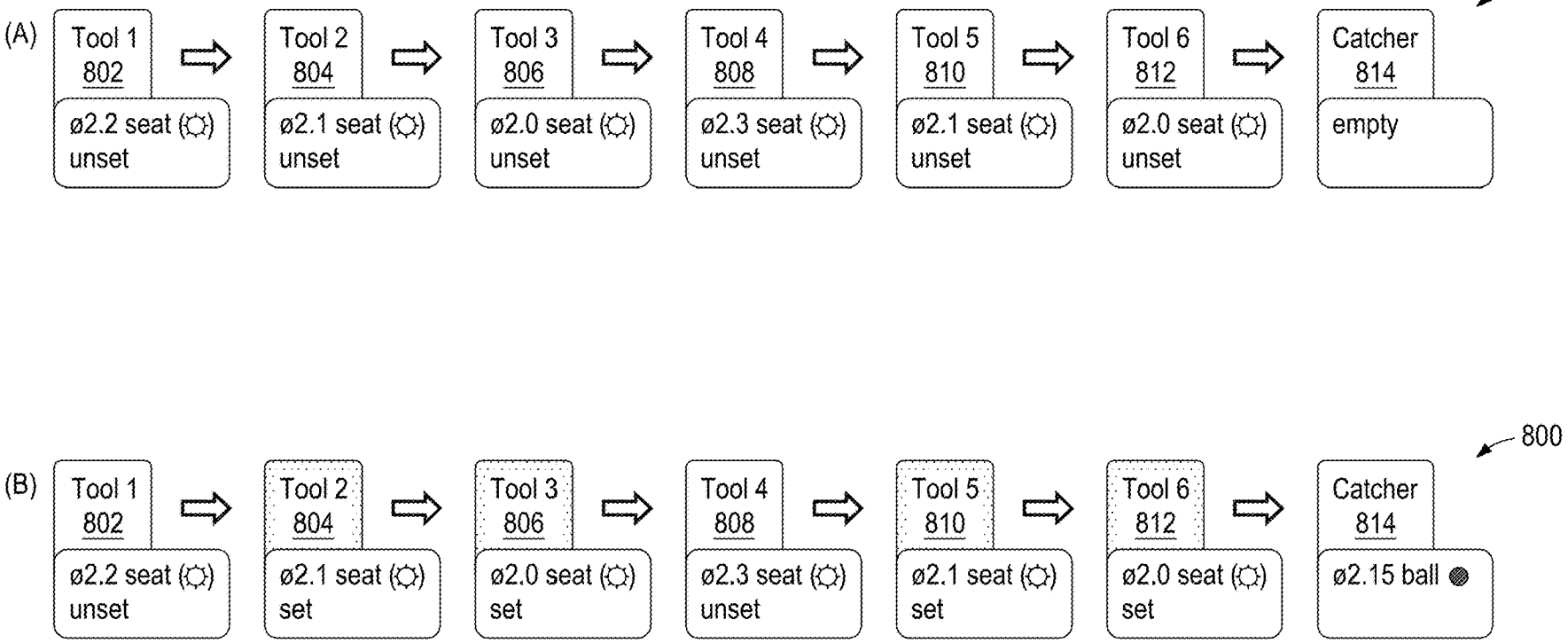
FIGS. 9 and 10 are schematic views of an alternate example tool string illustrating two alternate operational scenarios for activating the downhole tools out of sequence in accordance with one or more aspects of the present disclosure.

Referring to FIG. 9, an alternate operational scenario for the tool string 800 is illustrated. As illustrated in row (A), the each of the downhole tools 802, 804, 806, 808, 810, 812 may be initially arranged in deactivated or unset configuration. Rather than initially dropping a 2.05 inch ball as described above, an operator may drop a 2.15 inch diameter ball to move the tool string 800 to the configuration of row (B). The second, third, fifth and sixth downhole tools 804, 806, 810, 812 are activated while the first and fourth downhole tools 802, 808 remain in the deactivated configuration.

Figure 10:
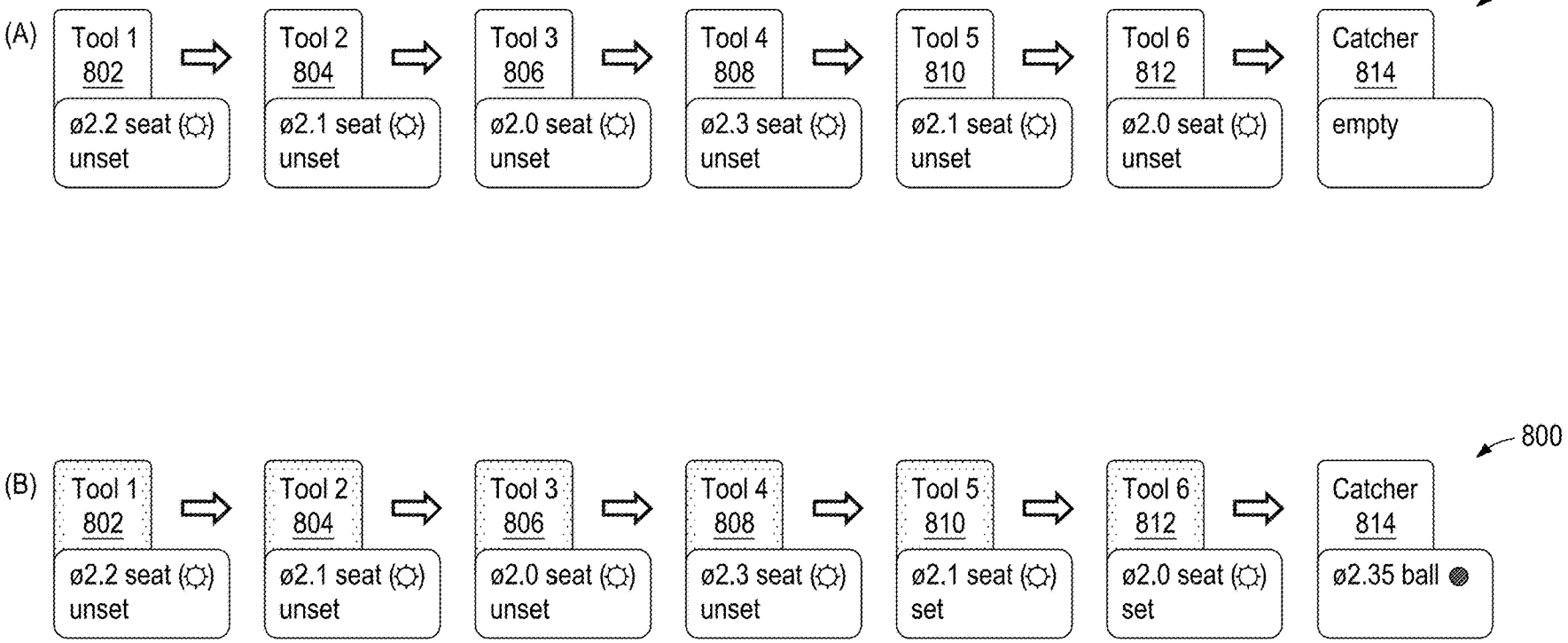

Referring to FIG. 10, another operational scenario for the tool string 800 is illustrated. If it is necessary to activate all the downhole tools 802, 804, 806, 808, 810, 812 simultaneously, a 2.35 inch ball may be dropped to move the tool string 800 from the initial configuration of row (A) to the activated configuration of row (B). Since the 2.35 inch diameter ball is larger than the plastically deformable seat of each of the downhole tools, the single 2.35 inch diameter ball may activate each of the downhole tools 802, 804, 806, 808, 810, 812 before landing in the tool catcher 814. Activation of all the downhole tools 802, 804, 806, 808, 810, 812 with a single ball may be beneficial in operations where concentrated media or chemicals are required. Activating multiple or all of the downhole tools 802, 804, 806, 808, 810, 812 may also be beneficial in an emergency or unexpected drilling scenario In the tool string 800, a single dropped ball can activate multiple tools, and an unlimited number of tools may be activated with a single dropped ball. A single dropped ball may activate all of the downhole tools that have a plastically deformable seat smaller than a diameter of the ball irrespective of their position in the tool string 800. The tools may be strategically placed in the tool string 800 and may be operated out of sequence. Dropping the largest size ball may activate all of the downhole tools 802, 804, 806, 808, 810, 812 in the tool string 800 simultaneously.

Embodiments disclosed herein include:

A. A method of conducting operations in a wellbore can include (a) deploying a tool string including at least a first downhole tool into the wellbore, the first downhole tool including a first seat and being selectively movable from a nonactivated configuration to an activated configuration to accomplish a task in the wellbore, (b) conveying a first ball downhole through a wellbore conduit to engage the first seat, (c) pumping a fluid behind the first ball to apply a force on the first ball against the first seat and thereby moving the first downhole tool from the deactivated configuration to the activated configuration and (d) increasing the force applied on the first ball to force the ball through the first seat and thereby plastically deform the first seat from an initial diameter to an enlarged diameter.

B. A wellbore system can include a wellbore conduit extending within a wellbore and at least one downhole tool having a flow path fluidly coupled to the wellbore conduit, wherein the at least one downhole tool is selectively movable from a nonactivated configuration to an activated configuration to accomplish a task in the wellbore. A plastically deformable seat can extend into the flow path of the at least one downhole tool and define an initial diameter of the flow path extending through plastically deformable seat. At least one ball can be conveyable through the flow path to engage the plastically deformable seat at the initial diameter and thereby obstructing flow of a fluid through the flow path such that a fluid pressure behind the at least one ball increases to move the at least one downhole tool from the nonactivated configuration to the activated configuration. Increasing the fluid pressure behind the at least one ball forces the at least one ball to plastically deform the plastically deformable seat and thereby define an enlarged diameter that permits passage of the at least one ball through the plastically deformable seat.

C. A downhole tool can include a tool body defining a flow path therethrough and an inner sliding sleeve slidable within the tool body. A plastically deformable seat can be secured to the inner sliding sleeve and extend radially into the flow path to define an initial diameter of the flow path extending through the plastically deformable seat. The plastically deformable seat can be responsive to a ball conveyed through the flow path and engaging the plastically deformable seat to obstruct flow through the flow path such that a fluid pressure behind the ball moves the inner sliding sleeve to a limit of travel. The plastically deformable seat plastically deforms as the fluid pressure behind the ball increases to define an enlarged diameter that permits passage of the at least one ball through the plastically deformable seat.

Each of embodiments A, B, and C may have one or more of the following additional elements in any combination: Element 1: wherein the tool string further includes a second downhole tool arranged downhole from the first downhole tool, the method further comprising conveying a second ball, larger than the first ball, through the wellbore conduit to engage a second seat of the second downhole tool and thereby activate the second downhole tool subsequent to plastically deforming the first seat. Element 2: further comprising catching the first ball and the second ball in a tool catcher arranged downhole from the first and second downhole tools. Element 3: further comprising dissolving the first and second balls within the tool catcher with the fluid. Element 4: wherein the tool string further includes a second downhole tool arranged therein, the method further comprising activating the second downhole tool with the first ball by engaging a second seat of the second downhole tool with the first ball. Element 5: wherein the activated configuration comprises first and second predetermined activated configurations, the method further comprising selecting a size of the ball to engage either a radially inner portion or a radially outer portion of the first seat to move the downhole tool to one of the first and second predetermined activated configurations. Element 6: further comprising securing the first seat in a flow path through the first downhole tool by clamping the first seat between a shoulder defined in the flow path and a threaded insert threaded into the flow path. Element 7: wherein moving the first downhole tool from the deactivated configuration to the activated configuration includes aligning radial openings defined in the first downhole tool to permit circulation of the fluid from the flow path to an exterior of the first downhole tool.

Element 8: wherein the at least one downhole tool is arranged in a tool string including a first downhole tool and a second downhole tool arranged downhole from the first downhole tool, wherein the first downhole tool includes the plastically deformable seat, and wherein a seat of the second downhole tool has a larger diameter than the initial diameter of the plastically deformable seat of the first downhole tool. Element 9: wherein the plastically deformable seat is tapered such that a radially inner portion of the plastically deformable seat has a smaller thickness than a radially outer portion of the plastically deformable seat. Element 10: wherein the plastically deformable seat includes a plurality of distinct layers of material, and wherein an upper layer defines a larger diameter therethrough than a diameter defined by a lower layer of the plastically deformable seat. Element 11: wherein the plastically deformable seat includes a plurality of castellations forming a discontinuous ring. Element 12: wherein the at least one downhole tool includes a sliding sleeve operably coupled to the plastically deformable seat, and wherein moving the at least one downhole tool to the activated configuration includes longitudinally displacing the sliding sleeve. Element 13: wherein the at least one downhole tool includes a threaded insert threaded into the sliding sleeve, and wherein the plastically deformable seat is captured between the threaded insert and a shoulder defined in the sliding sleeve. Element 14: wherein the plastically deformable seat includes a protrusion extending longitudinally into a circumferential recess defined in the threaded insert.

Element 15: further comprising a threaded insert threaded into the inner sliding sleeve, wherein the plastically deformable seat is captured between the threaded insert and a shoulder defined in the inner sliding sleeve. Element 16: wherein the plastically deformable seat includes at least one of a taper, circumferential castellations defining a discontinuous ring, or a plurality of distinct layers of material. Element 17: further comprising an outer sliding sleeve connected to the inner sliding sleeve, wherein longitudinally moving the inner sliding sleeve to the limit of travel aligns radial openings in the tool body and the outer sliding sleeve to permit circulation of the fluid out of the downhole tool from the flow path.

By way of non-limiting example, exemplary combinations applicable to A, B, and C include: Element 1 with Element 2; Element 2 with Element 3; Element 12 with Element 13; Element 12 with Element 14; Element 15 with Element 16 and Element 16 with Element 17.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A method of conducting operations in a wellbore, the method comprising:

deploying a tool string into the wellbore, the tool string comprising a plurality of downhole tools each including a respective plastically deformable seat, the plurality of downhole tools including at least a first downhole tool and a second downhole tool disposed downhole of the first downhole tool, the first downhole tool including a first plastically deformable seat and the second downhole tool including a second plastically deformable seat having an initial diameter larger than an initial diameter of the first plastically deformable seat, the first and second downhole tools being selectively movable from a nonactivated configuration to an activated configuration to accomplish a task in the wellbore;

selecting a diameter of at least one ball including at least a first ball such that the at least one ball is operable to activate a plurality of the downhole tools irrespective of their relative positions in the tool string by engaging and plastically deforming any plastically deformable seat having an initial diameter smaller than the diameter of the at least one ball;

conveying the first ball downhole through the wellbore conduit to engage the first seat;

pumping a fluid behind the first ball to apply a force on the first ball against the first seat and thereby moving the first downhole tool from the deactivated configuration to the activated configuration; and increasing the force applied on the first ball to force the first ball through the first seat and thereby plastically deform the first seat from the initial diameter to an enlarged diameters, wherein plastically deforming the first seat permits the first ball to pass through the first seat without being retained in the first downhole tool.

2. The method of claim 1, wherein the at least one ball further includes a second ball, larger than the first ball, the method further comprising:

conveying the second ball through the wellbore conduit to engage a second seat of the second downhole tool and thereby activate the second downhole tool subsequent to plastically deforming the first seat.

3. The method of claim 2, further comprising catching the first ball and the second ball in a tool catcher arranged downhole from the first and second downhole tools.

4. The method of claim 3, further comprising dissolving the first and second balls within the tool catcher with the fluid.

5. The method of claim 1, further comprising activating the second downhole tool with the first ball by engaging a second seat of the second downhole tool with the first ball.

6. The method of claim 1, wherein the activated configuration comprises first and second predetermined activated configurations, wherein the first seat comprises a tapered plastically deformable ring such that a radially inner portion of the ring has a smaller thickness than a radially outer portion of the ring, the method further comprising:

selecting a size of the first ball to engage either a radially inner portion or a radially outer portion of the tapered first seat to move the first downhole tool to one of the first and second predetermined activated configurations.

7. The method of claim 1, further comprising securing the first seat in a flow path through the first downhole tool by clamping the first seat between a shoulder defined in the flow path and a threaded insert threaded into the flow path.

8. The method of claim 7, wherein moving the first downhole tool from the deactivated configuration to the activated configuration includes aligning radial openings defined in the first downhole tool to permit circulation of the fluid from the flow path to an exterior of the first downhole tool.

9. A wellbore system, comprising:

a wellbore conduit extending within a wellbore;

at least one downhole tool having a flow path fluidly coupled to the wellbore conduit, the at least one downhole tool being selectively movable from a nonactivated configuration to an activated configuration to accomplish a task in the wellbore;

a plastically deformable seat extending into the flow path of the at least one downhole tool and defining an initial diameter of the flow path extending through plastically deformable seat; and at least one ball conveyable through the flow path to engage the plastically deformable seat at the initial diameter and thereby obstructing flow of a fluid through the flow path such that a fluid pressure behind the at least one ball increases to move the at least one downhole tool from the nonactivated configuration to the activated configuration, wherein increasing the fluid pressure behind the at least one ball forces the at least one ball to plastically deform the plastically deformable seat and thereby define an enlarged diameter that permits passage of the at least one ball through the plastically deformable seat, wherein the wellbore conduit carries a tool string comprising a plurality of downhole tools including the at least one downhole tool, each downhole tool including a respective plastically deformable seat defining a respective initial diameter, and wherein the plurality of downhole tools includes a first downhole tool and a second downhole tool, the first downhole tool being disposed uphole of the second downhole tool and having a plastically deformable seat with an initial diameter smaller than an initial diameter of a plastically deformable seat of the second downhole tool, and wherein the enlarged diameter of the plastically deformable seat of the first downhole tool permits the at least one ball to pass through the first downhole tool without being retained therein, and a diameter of the at least one ball is selected such that the at least one ball activates at least two of the plurality of the downhole tools irrespective of their relative positions in the tool string by engaging and plastically deforming any of the plastically deformable seats having an initial diameter smaller than the diameter of the at least one ball.

10. The system of claim 9, wherein at least a selected one of the respective plastically deformable seats is tapered such that a radially inner portion of the selected plastically deformable seat has a smaller thickness than a radially outer portion of the selected plastically deformable seat.

11. The system of claim 9, wherein at least a selected one of the plastically deformable seats includes a plurality of distinct layers of material, and wherein an upper layer defines a larger diameter therethrough than a diameter defined by a lower layer of the selected plastically deformable seat.

12. The system of claim 9, wherein at least a selected one of the plastically deformable seats includes a plurality of castellations forming a discontinuous ring.

13. The system of claim 9, wherein the at least one downhole tool includes a sliding sleeve operably coupled to the plastically deformable seat, and wherein moving the at least one downhole tool to the activated configuration includes longitudinally displacing the sliding sleeve.

14. The system of claim 13, wherein the at least one downhole tool includes a threaded insert threaded into the sliding sleeve, and wherein the plastically deformable seat is captured between the threaded insert and a shoulder defined in the sliding sleeve.

15. The system of claim 13, wherein the plastically deformable seat includes a protrusion extending longitudinally into a circumferential recess defined in the threaded insert.

16. A downhole tool, comprising:

a tool body defining a flow path therethrough;

an inner sliding sleeve slidable within the tool body;

a threaded insert threaded into the inner sliding sleeve, wherein the plastically deformable seat is captured between the threaded insert and a shoulder defined in the inner sliding sleeve; and a plastically deformable seat secured to the inner sliding sleeve and extending radially into the flow path to define an initial diameter of the flow path extending through the plastically deformable seat, the plastically deformable seat being responsive to a ball conveyed through the flow path and engaging the plastically deformable seat to obstruct flow through the flow path such that a fluid pressure behind the ball moves the inner sliding sleeve to a limit of travel, wherein the plastically deformable seat plastically deforms as the fluid pressure behind the ball increases to define an enlarged diameter that permits passage of the at least one ball through the plastically deformable seat; and an outer sliding sleeve connected to the inner sliding sleeve, wherein longitudinally moving the inner sliding sleeve to the limit of travel aligns radial openings in the tool body and the outer sliding sleeve to permit circulation of the fluid out of the downhole tool from the flow path.

17. The downhole tool of claim 16, wherein the plastically deformable seat includes a taper.

18. The downhole tool of claim 16, wherein the plastically deformable seat comprises an annular ring extending circumferentially around the flow path and providing hoop strength to the plastically deformable seat.

19. The downhole tool of claim 16, wherein the plastically deformable seat is constructed of a metallic material and may be permanently dilated in response to passage of plastically deformable such that passage of the ball therethrough.

20. The downhole tool of claim 16, wherein the limit of travel of the inner sliding sleeve is defined by engagement of a connector that couples the inner sliding sleeve to the outer sliding sleeve with an end of a longitudinal slot formed in the tool body.

* * * * *